US008033127B2

(12) United States Patent
Wiggs

(10) Patent No.: US 8,033,127 B2
(45) Date of Patent: Oct. 11, 2011

(54) DIRECT EXCHANGE SYSTEM DESIGN IMPROVEMENTS

(75) Inventor: B. Ryland Wiggs, Franklin, TN (US)

(73) Assignee: Earth To Air Systems, LLC, Franklin, TN (US)

( * ) Notice: Subject to any disclaimer, the term of this patent is extended or adjusted under 35 U.S.C. 154(b) by 627 days.

(21) Appl. No.: 12/174,520

(22) Filed: Jul. 16, 2008

(65) Prior Publication Data

US 2009/0133424 A1 May 28, 2009

Related U.S. Application Data

(60) Provisional application No. 60/950,053, filed on Jul. 16, 2007.

(51) Int. Cl.
*F25D 23/12* (2006.01)

(52) U.S. Cl. ..... 62/260; 62/324.6; 62/513

(58) Field of Classification Search ..... 62/260, 62/324.2, 324.6, 502, 513; 165/45
See application file for complete search history.

(56) References Cited

U.S. PATENT DOCUMENTS

| | | | | |
|---|---|---|---|---|
| 4,343,999 | A * | 8/1982 | Wolf | 290/2 |
| 4,873,834 | A | 10/1989 | Cox | |
| 5,146,755 | A | 9/1992 | Abdelmalek | |
| 5,150,585 | A | 9/1992 | Markiewicz | |
| 5,485,879 | A * | 1/1996 | Lannes | 122/18.31 |
| 5,651,265 | A | 7/1997 | Grenier | |
| 5,875,644 | A | 3/1999 | Ambs | |
| 6,167,715 | B1 * | 1/2001 | Hebert | 62/260 |
| 6,628,206 | B1 * | 9/2003 | Soulier | 340/854.4 |
| 6,691,924 | B1 * | 2/2004 | Vestergaard et al. | 236/92 B |
| 2006/0213218 | A1 * | 9/2006 | Uno et al. | 62/467 |

FOREIGN PATENT DOCUMENTS

| | | | |
|---|---|---|---|
| DE | 30 01 315 | A1 | 7/1981 |
| DE | 3001315 | | 7/1981 |
| DE | 41 40 778 | A1 | 12/1992 |
| DE | 4140778 | | 12/1992 |
| DE | 197 35 05 085 | A1 | 2/1999 |
| DE | 19735085 | | 2/1999 |
| DE | 103 41 289 | A1 | 6/2005 |
| DE | 10341289 | | 6/2005 |
| FR | 2 763 672 | | 11/1998 |
| FR | 2763672 | | 11/1998 |
| JP | 04 148161 | | 5/1992 |
| JP | 4148161 | | 5/1992 |
| JP | 2005 172336 | | 6/2005 |
| JP | 2005172336 | | 6/2005 |

* cited by examiner

*Primary Examiner* — Mohammad Ali
(74) *Attorney, Agent, or Firm* — Miller, Matthias & Hull LLP

(57) ABSTRACT

An R-410A DX heating/cooling system with: an electrical generating expansion device; with a protective means for refrigerant transport tubing containing dissimilar metals and/or in corrosive environments; with an automatic heating mode expansion device; with a TXV by-pass design; with retractable sub-surface tubing designs; with sub-surface line set sizing at varying depths and lengths; with reciprocal compressor sizing; with a DX Hydronic system design; with an improved oil separator float design; with a mobile DX system design; and with a resting module DX system design.

22 Claims, 3 Drawing Sheets

DIRECT EXCHANGE SYSTEM DESIGN IMPROVEMENTS

CROSS-REFERENCE TO RELATED APPLICATION

This application claims the benefit of U.S. Provisional Application No. 60/950,053, filed on Jul. 16, 2007.

FIELD OF THE DISCLOSURE

The present disclosure relates to a geothermal direct exchange ("DX") heating/cooling system comprising various design improvements and various specialty applications.

BACKGROUND OF THE DISCLOSURE

Geothermal ground source/water source heat exchange systems typically use fluid-filled closed loops of tubing buried in the ground, or submerged in a body of water, so as to either absorb heat from, or to reject heat into, the naturally occurring geothermal mass and/or water surrounding the buried or submerged fluid transport tubing. The tubing loop is extended to the surface and is then used to circulate one of the naturally warmed and naturally cooled fluid to an interior air heat exchange means.

Common and older design geothermal water-source heating/cooling systems typically circulate, via a water pump, a fluid comprised of water, or water with anti-freeze, in plastic (typically polyethylene) underground geothermal tubing so as to transfer geothermal heat to or from the ground in a first heat exchange step. Via a second heat exchange step, a refrigerant heat pump system is used to transfer heat to or from the water. Finally, via a third heat exchange step, an interior air handler (typically comprised of finned tubing and a fan, as is well understood by those skilled in the art) is used to transfer heat to or from the refrigerant to heat or cool interior air space.

Newer design geothermal DX heat exchange systems, where the refrigerant fluid transport lines are placed directly in the sub-surface ground and/or water, typically circulate a refrigerant fluid, such as R-22 or the like, in sub-surface refrigerant lines, typically comprised of copper tubing, to transfer geothermal heat to or from the sub-surface elements via a first heat exchange step. DX systems only require a second heat exchange step to transfer heat to or from the interior air space, typically also by means of an interior air handler. Consequently, DX systems are generally more efficient than water-source systems because less heat exchange steps are required and because no water pump energy expenditure is necessary. Further, since copper is a better heat conductor than most plastics, and since the refrigerant fluid circulating within the copper tubing of a DX system generally has a greater temperature differential with the surrounding ground than the water circulating within the plastic tubing of a water-source system, generally, less excavation and drilling is required, and installation costs are lower, with a DX system than with a water-source system.

While most in-ground/in-water DX heat exchange designs are feasible, various improvements have been developed intended to enhance overall system operational efficiencies. Several such design improvements, particularly in direct expansion/direct exchange geothermal heat pump systems, are taught in U.S. Pat. No. 5,623,986 to Wiggs; in U.S. Pat. No. 5,816,314 to Wiggs, et al.; in U.S. Pat. No. 5,946,928 to Wiggs; and in U.S. Pat. No. 6,615,601 B1 to Wiggs, the disclosures of which are incorporated herein by reference. Such disclosures encompass both horizontally and vertically oriented sub-surface heat geothermal heat exchange means, using historically conventional refrigerants, such as R-22 . The use of a refrigerant operating at higher pressures than R-22, such as R-410A, has been found to be advantageous for use in a DX system incorporating at least one of the disclosures as taught herein. R-410A is an HFC azeotropic mixture of HFC-32 and HFC-125.

DX heating/cooling systems have multiple primary objectives. The first is to provide the greatest possible operational efficiencies. This directly translates into providing the lowest possible heating/cooling operational costs, as well as other advantages, such as, for example, materially assisting in reducing peaking concerns for utility companies. A second is to operate in an environmentally safe manner by using environmentally safe components and fluids. A third is to provide an economically feasible installation means at the lowest possible initial cost, so as to enhance system payback opportunities. A fourth is to provide sub-surface installation means within the smallest surface area possible. A fifth is to increase interior comfort levels. A sixth is to increase long-term system durability, and a seventh is to facilitate ease of service and maintenance.

Historically, DX heating/cooling systems, even though more efficient than other conventional heating/cooling systems, have experienced practical limitations created by the relatively large surface land areas necessary to accommodate the sub-surface heat exchange tubing. For example, with R-22 systems, a typical land area of 500 square feet per ton of system design capacity was required in first generation designs to accommodate a shallow (within 10 feet of the surface) matrix of multiple, distributed, copper heat exchange tubes. Early generation borehole designs still required about one 50 foot, to one 100 foot, (maximum) depth wells/boreholes per ton of system design capacity, preferably spaced at least about 20 feet apart. Such requisite surface areas effectively precluded system applications in many commercial and/or high density residential applications.

The subject disclosures primarily relate to DX systems installed with vertically oriented sub-surface geothermal heat exchange means, although a means to use the subject disclosure in a lake, in a fully water saturated borehole, or the like, is also disclosed. In a DX system design, primary objectives are to increase system operational efficiency levels, to reduce installation costs, to increase interior comfort levels, to increase long-term system durability, and to facilitate ease of service and maintenance. Also, a means of installing a DX Hydronic system is disclosed, with an objective of applying DX system advantages, in lieu of conventional boiler/chiller systems, and in lieu of traditional water-source geothermal heat exchange loops, in an interior building/structure. Further, a means of improving the life and reliability of an oil separator for use in a DX system would be of significant importance. Lastly, a means for providing a "mobile" DX system, that not only provided cooling, but that also generated potable water from natural moisture in the air, would also be of value for transient applications, such as for military use and for temporary field office use (such as for temporary oil exploration and/or engineering field office and/or housing facilities, or the like).

Consequently, a means to accomplish at least one of the said primary objectives would be preferable. The present disclosure provides solutions to these preferable objectives, as hereinafter more fully described.

SUMMARY OF THE DISCLOSURE

It is an object of the present disclosures to further enhance and improve at least one of the efficiency, the interior comfort levels, the ease of service and maintenance, the durability, and to reduce the high installation costs, of predecessor direct expansion, geothermal heating/cooling system, designs; as well as to provide unique and improved new DX system applications. In summary, the present disclosures incorporate an R-410A DX heating/cooling system with: an electrical generating expansion device; with a protective means for refrigerant transport tubing containing dissimilar metals and/or in corrosive environments; with an automatic heating mode expansion device; with a TXV by-pass design; with retractable sub-surface tubing designs; with sub-surface line set sizing at varying depths and lengths; with reciprocal compressor sizing; with a DX Hydronic system design; with an improved oil separator float design; with a mobile DX system design; and with a resting module DX system design. The objectives of these disclosures are accomplished as follows:

(1) All heat pump systems use expansion devices, as is well understood by those skilled in the art. Current art expansion devices may be self-adjusting, automatic, fixed pin orifice types, and the like, as is also well understood by those skilled in the art. The object of an expansion device in a heat pumps system application is to maintain a high refrigerant pressure behind the expansion device, and to supply a low pressure refrigerant on the other forward side of the expansion device, so as to reduce both the pressure and the temperature on the low side, so to create a greater temperature differential which enables the circulating refrigerant, circulating within refrigerant transport tubing, to more readily absorb heat from, or to reject heat into, the surrounding environment. Here, "behind" and "forward" of the expansion device designations relate to the directional flow of the heat pump's refrigerant through the expansion device, with "behind" typically consisting of refrigerant flow with higher pressures and with "forward" typically consisting of refrigerant flow with lower pressures.

One of the design improvements taught herein is to use the turbine of an electric generating device as the refrigerant expansion device for a DX system, where operational efficiencies are typically a very high priority. The turbine of an electric generator, of any type, can be used to provide desired resistance to the refrigerant flow so that the desired refrigerant high pressure on the back side is maintained, while the desired refrigerant low pressure on the forward side is facilitated. Such an electric generating refrigerant expansion device enables a recapture of a portion of the energy required to operate the system's compressor, thereby increasing overall system efficiency. The electrical energy produced by the electric generating expansion device could be used to help power the system's interior air handler fan, or the like. Such an electric generating expansion device could particularly be used to increase overall operational efficiencies in a DX geothermal heating/cooling system, where operational efficiencies are a high priority, and/or could be used in any other heat pump system. Heat pump systems are well understood by those skilled in the art.

(2) A protective coating is desirable for metal refrigerant transport tubing situated in a corrosive environment. Such a protective coating preferably provides the requisite protection while not materially impairing heat transfer. Extensive testing has shown that for conductive heat transfer purposes, such as in DX system sub-surface metal heat transport tubing, a plastic coating that is resistant to corrosive elements, such as polyethylene, or the like, is necessary. However, such a plastic coating inhibits conductive heat transfer. Thus, the plastic coating, comprised of polyethylene, or the like, is preferably strong enough to remain intact, but thin enough so as to minimize adverse heat transfer abilities. Extensive testing has shown that a plastic coating of a 0.01 inch to 0.015 inch thick wall is preferable suited to accomplish such objectives. A plastic coating below a 0.01 inch thick wall is too easily compromised via accidental scrapes, or the like, and a plastic coating above a 0.015 inch thick wall can unduly inhibit conductive heat transfer abilities beyond 10% of uncoated metal refrigerant transport tubing. The plastic wall coating should preferably be comprised of a low density polyethylene, or the like.

In addition to providing a protective coating, the sub-surface liquid refrigerant transport tubing of a DX system should preferably be insulated with a heat transfer inhibitive coating. Testing has demonstrated that a preferable insulation for such applications is a low density polyethylene with a wall thickness of at least 0.05 inches.

(3) In some geographic locations, the copper content of groundwater is at high levels, and increasing potential groundwater copper content could be viewed as an environmental concern. In such instances, in lieu of using common copper refrigerant transport tubing to effect geothermal heat transfer in a DX system, several design improvements should be implemented. One would be to coat the copper tubing with a plastic coating, as explained in detail in the immediately preceding paragraph (segment 2 herein). The other would be to use subsurface refrigerant transport tubing comprised of something other than copper, such as aluminum, or the like. The use of a metal transport tube is preferred, as metal typically has better heat conductivity than plastic tubing, or the like.

However, virtually all heat pump systems in the world, including DX system, primarily use copper tubing. As is well understood by those skilled in the art, copper tubing is typically always brazed together with silver solder, which silver solder is generally not suitable for brazing copper to a dissimilar metal such as aluminum. Thus a means of connecting copper tubing extending from interior equipment, not exposed to corrosive environments, with another refrigerant transport tubing type, such as aluminum, for example, that is resistant to a particular corrosive environment, and/or that is preferable over the use of copper for environmental reasons (too high a copper content can kill bacteria used for sewage treatment, for example), is preferably included. Testing has shown that when one connects copper to a dissimilar metal, a means of preventing adverse galvanic reactions and/or deterioration of the anode metal may be provided. Thus, any sub-surface refrigerant transport tubing used, other than copper, should preferably typically be connected to the heat pump system's standard copper tubing via special alloys, other than silver solder, and/or via special brazing techniques and is preferably covered via special protective coatings, such as a polyethylene coating, or the like, which would be well known to metallurgists (although not well known in the geothermal heating/cooling art which typically only uses polyethylene walled tubing for water-source systems, and which typically only uses copper tubing for DX systems), so as to prevent any refrigerant transport tubing deterioration at any dissimilar metal connection point. If the special coating is not applied to all of the dissimilar metal connection points, corrosion could result, particular in moist/wet ground.

Thus, so as to protect such sub-surface dissimilar metal connection points, a coating of polyethylene, or the like, should preferably be applied, via at least one of a shrink wrap, a glue, or the like. Shrink wraps and glues are well understood by those skilled in the art. A preferable protective polyethylene coating should preferably have between a 0.02 and 0.1 inches thick wall, with thicker coatings used in harsher environments.

(4) Self-adjusting thermostatic expansion valves, and automatic expansion valves, are well understood by those skilled in the art, and are typically used in heat pumps system applications as expansion devices. However, in a DX system application, in the heating mode, such self-adjusting and automatic expansion devices do not functionally operate at optimum levels because of the extremely long sub-surface refrigerant transport tubing geothermal heat exchange tubing distances, which cause such expansion devices to continuously "hunt" during relatively short system operational periods until thermostat setting are satisfied. When "hunting", high pressure psi fluctuations between 40 to 100 psi can occur, which, in turn eliminates stable system operating conditions and reduce operational efficiencies. As a result, certain sized fixed pin orifice expansion devices have been previously proprietarily tested for use in the heating mode of DX heat pump systems, which pins eliminate hunting, but which pins also only provide optimal operating conditions within certain ground temperature ranges, which directly correspond to certain respective refrigerant fluid temperatures exiting the ground/subsurface geology at any particular geographic location.

Thus, at least one of a self-adjusting expansion device, an automatic expansion device, and an electronic expansion device would be preferable for use in the heating mode of a DX system, so as to facilitate optimum system operation under a wider range of ground temperatures, such as naturally exist between the earth's poles and equator, and such as are typically somewhat modified by DX system operation in the summer (warming the ground) and in the winter (cooling the ground) by as much as approximately 20 degrees F., or more. The standard operation of a self-adjusting expansion device, an automatic expansion device, and an electronic expansion device are well understood by those skilled in the art and are not described in detail herein.

Testing has shown that an automatic expansion device, or the like, can be used for DX system applications in the heating mode, so long as three modifications are made: two to the traditional valve design and the third to the traditional temperature sensing valve location on the vapor line exiting the interior heat exchanger's condenser. In the heating mode of a DX system, the evaporator is the ground.

Specifically, first, the traditional automatic expansion device sizing, to be preferably used with an R-410A refrigerant, or the like, may be increased by at least a factor of 20% over standard heat pump system tonnage designs based upon an R-22, or the like, refrigerant. For example, for a 4 ton DX system design, instead of using a typical 4 ton automatic valve, at least a 5 ton automatic vale may be used. Traditional automatic expansion device sizing is well understood by those skilled in the art. System sizing is typically performed in tons, where one ton equals 12,000 BTUS, and system sizing, as per ACCA Manual J, or the like, is well understood by those skilled in the art.

Second, the automatic valve may contain at least one of a mostly liquid refrigerant flow by-pass means and a bleed port, so as to insure a certain amount of extra refrigerant is always provided to the sub-surface evaporator. The at least one of a by-pass means, which may be in the form of a liquid refrigerant transport line around the automatic expansion device, which by-pass line contains a fixed orifice pin restrictor, or, alternatively, which may be in the form of a bleed port cut directly within the automatic valve itself.

The preferred pin restrictor borehole size, or alternative bleed port size, is shown below in inches, may match the actual compressor size, in BTUs, in the system, as opposed to the actual capacity load design of the system in BTUs, which may differ, and should preferably consist of the following formula pin orifice or bleed port sizes in inches per ton of system design capacity, plus or minus 10%, at the following specified exiting (exiting from the sub-surface heat exchange geology) refrigerant temperature in degrees C.:

First. Multiply the BTU size of the system's compressor in thousands (a 60,000 BTU compressor's multiple formula size would be 60, and a 24,000 BTU compressor's multiple formula size would be 24, etc.) by the factor of 0.0000391 to determine the correct pin restrictor orifice area size, in inches, at 0 degrees C., or less, exiting refrigerant temperature, for the actual system's compressor.

Second. Increase the pin restrictor size (pin restrictor sizes are commonly measured in inch diameters and are well understood by those skilled in the art) by a factor of one pin size per one-half degree C. (the same as increasing the pin size by a factor of two pin sizes per one degree C.) for the refrigerant temperature in degrees C exiting from the sub-surface geology. For example, if the exiting refrigerant temperature is 15 degrees C (59 degrees F.), then multiply 15 by two full pin sizes to obtain a factor of 30 . Add 30 to the base pin size calculated at 0 degrees C. to obtain the correct pin restrictor (orifice) size.

For example, if the compressor is sized at a 30,000 BTU output capacity, multiply 30 times 0.0000391 to obtain the correct pin restrictor orifice area size of 0.001173 at 0 degrees C., which approximately equals a pin diameter size of 0.039, which is commonly referred to as a "39" pin. Add the factor of 30 to 39, and the correct pin size of 69 is obtained for use in the heating mode with a 30,000 BTU compressor where the refrigerant temperature exiting from the sub-surface geology is 15 degrees C.

Distributed Lines. If the DX system to be installed has equally distributed liquid refrigerant transport lines traveling into the geothermal heat exchange subsurface area, then the area of the pin orifice size calculated may be calculated by dividing the compressor capacity size in BTUs by the number of equally distributed liquid refrigerant transport lines, and then follow the procedure outlined in subparagraph number 1 above to determine the correct pin size in each respective well.

For example, for a 60,000 BTU compressor unit (not necessarily the system design size, but, rather, the actual compressor capacity size), with two equally distributed liquid refrigerant transport lines traveling into the subsurface geothermal heat exchange area, one would divide 60,000 BTUs by 2, which equals 30,000 BTUs (per individual respective liquid refrigerant transport line), and then one would multiply 30 by 0.0000391 to determine the correct pin restrictor orifice area size, in inches, at a 0 degrees C. exiting refrigerant temperature, which would be an area size of 0.001173 inches, which would equate to an approximate 0.039 inch pin restrictor diameter size, or a "39" pin at an exiting refrigerant temperature of 0 degrees C. Add the factor of 30 (15 degrees C. times 2 pin sizes) to the base 39 pin at 0 degrees C., and the correct pin size of 69 is obtained for use in each of the two respective liquid lines for use in the heating mode with a 60,000 BTU compressor where the exiting refrigerant temperature is 15 degrees C.

If there were two equally distributed liquid refrigerant transport lines used in the sub-surface geothermal heat exchange tubing, for example, then a separate pin restrictor housing unit and pin restrictor should preferably be placed within each respective distributed liquid refrigerant transport line (so as to help insure equal refrigerant flow rates through each respective line).

Third, regarding the location of the automatic valve's temperature sensing bulb, while traditionally recommended not to be at one of a position not directly on top, nor directly on the bottom, of the evaporator line in the heating mode (a 10:'o'clock, or the like, position is generally recommended), testing has shown that in a DX system application, the bulb should preferably be situated directly on the top of the evaporator line exiting the sub-surface heat exchange field, at a 12:00 o'clock position, for optimum results.

In the alternative, an electronic valve, with pre-determined, settings, could be used in lieu of other alternatives mentioned and described herein, however, electronic valves are not preferable in that every electronic component added to a DX system complicates the system and provides added component failure risks, thereby potentially impairing the preferred optimum durability of the DX system design. However, if an electronic valve were to be used for such purpose, the electronic valve settings may be designed to operate within the above-described parameters, so as to provide the optimum bleed port size per actual refrigerant degree C. temperature exiting the sub-surface environment.

(5) While previous proprietary testing has demonstrated that, in conjunction with an R-410A refrigerant (instead of with a conventional R-22 refrigerant), one of a by-pass line around a self-adjusting thermostatic expansion valve/device ("TXV") and a bleed port through a TXV is required to facilitate cooling mode system operation at the beginning of a cooling season when the sub-surface ground temperature is abnormally cold via heat being withdrawn throughout the winter, an improved means of facilitating DX system operation under such conditions is to provide an automatically operating valve in the TXV by-pass line. TXVs are well understood by those skilled in the art. When preferably using an R-410A refrigerant, instead of the common R-22 refrigerant, or the like, in a DX system design, such an automatically operating valve in the TXV's by-pass line should preferably provide a fully opened TXV refrigerant transport by-pass line, which line has an interior diameter equal to the size of the system's liquid refrigerant transport line between the compressor unit and the air handler (typically a ⅜ inch O.D. line for 1 to 2.5 ton system designs and a ½ inch O.D. line for 3 to 7.5 ton system designs, for example). The automatic valve in the TXV by-pass line preferably begins to close off the by-pass line at 50 psi, and then proportionately modulates to fully close off the by-pass line when 80 psi is reached in the subject liquid refrigerant transport line into the interior heat exchanger (typically an air handler).

In the alternative, an electronic valve, with pre-determined, settings, could be used in lieu of the automatically operating valve described herein, however, electronic valves are not preferable in that every electronic component added to a DX system complicates the system and provides added component failure risks, thereby potentially impairing the preferred optimum durability of the DX system design. In the alternative, an electronic valve, with pre-determined, settings, could be used in lieu of other alternatives mentioned and described herein, however, electronic valves are not preferable in that every electronic component added to a DX system complicates the system and provides added component failure risks, thereby potentially impairing the preferred optimum durability of the DX system design. However, if an electronic valve were to be used for such purpose, the electronic valve settings may be designed to operate within the described parameters.

(6) While the ability to install retractable geothermal heat exchange refrigerant transport tubing within fluid filled containment piping in a DX system design has been a proprietary development of B. Ryland Wiggs, extensive testing has reflected an optimum design for such. Namely, 4 inch I.D. (interior diameter) metal piping, with a sealed lower distal end cap, should be installed within an approximate 5 to 6 inch diameter borehole/well. The exterior of the boreholes should preferably be grouted with a cementitious type grout, such as Grout 111. The smaller liquid refrigerant transport line within the well/borehole should preferably be insulated with at least a 0.05 inch thick wall low density solid state polyethylene insulation, or the like, that is not corrosive to the refrigerant transport tubing.

Such a design, used in conjunction with a preferred R-410A refrigerant, is optimally used in conjunction with a 0.0625 foot O.D. vapor refrigerant grade transport line and a 0.03125 foot O.D. liquid refrigerant grade transport line (typically copper refrigerant transport lines) in wells of a 400 foot depth, or less, which liquid and vapor lines are coupled at or near the bottom of the well so as to provide at least one of the system's geothermal heat exchange loops.

Such a design is optimally used in conjunction with a 0.0625 foot O.D. vapor refrigerant grade transport line and a 0.04166 foot O.D. liquid refrigerant grade transport line (typically copper refrigerant transport lines) in wells of a 401 foot to a 600 foot depth, which liquid and vapor lines are coupled at or near the bottom of the well so as to provide at least one of the system's geothermal heat exchange loops.

If the metal refrigerant transport loop containment piping is installed within a corrosive environment, as opposed to using thick walled (¼ inch wall, or the like) polyethylene containment tubing, the metal pipe should preferably be coated with a 0.01 inch to a 0.015 inch thick wall plastic coating of polyethylene, or the like. Such a thin plastic coating materially reduces the heat transfer inhibition created by thicker walled plastic pipe, thereby materially increasing system operational efficiencies and thereby materially reducing any otherwise requisite 15% to 20% additional heat transfer loop lengths, occasioned via use of commonly used approximate ⅜ inch to ¼ inch thick, or thicker, plastic walled containment pipe, by a factor of about 50% to 80% in most common situations.

(7) For optimum system utility and efficiency performance, in each respective individual well/borehole and/or in each respective individual sub-surface geothermal heat transfer line loop segment of a DX system, preferably operating with an R-410A refrigerant, the metal, or other similarly highly heat conductive vapor refrigerant transport tubing, used for heat transfer purposes should preferably have a 0.0625 foot O.D., plus or minus 10%, vapor refrigerant grade transport line, and a 0.03125 foot O.D., plus or minus 10%, liquid refrigerant grade transport line used for refrigerant transport in wells of a 400 foot depth, or less, and should preferably have a 0.0625 foot O.D., plus or minus 10%, vapor refrigerant grade transport line and a 0.04166 O.D., plus or minus 10%, liquid refrigerant grade transport line for refrigerant transport in wells of a 401 foot to a 600 foot depth.

Further, the vapor refrigerant transport line used for geothermal heat transfer should preferably be comprised of a length equal to 0.01 feet per BTU of system design load capacity. However, where the metal, or other similarly highly heat conductive vapor refrigerant transport tubing used for heat transfer purposes, is coated with a 0.01 inch to a 0.015 inch thick wall of a protective plastic coating, such as polyethylene, the vapor refrigerant transport line used for geothermal heat transfer should preferably be comprised of a length equal to 0.0125 feet per BTU of system design load capacity. A geothermal heat transfer loop is comprised of a liquid refrigerant transport line coupled to a vapor refrigerant transport line.

(8) To achieve very high levels of efficiency, a DX system should preferably operate with an R-410A refrigerant and a reciprocal compressor 24 (reciprocal compressors are well understood by those skilled in the art. The reciprocal compressor should preferably be downsized 15%, plus or minus 4% of 100%, of the system design capacity in BTUs. System design capacities in BTUs are well understood by those skilled in the art, and are typically calculated via ACCA Manuel J, or the like. Thus, for a five ton, or 60,000 BTU, system load design, the actual DX system compressor 24 size should be one of a 51,000 BTU capacity, plus or minus 4%.

(9) While circulating water loops within a building/structure are well know as a means of providing heating and cooling, such a means typically employs the use of a conventional boiler to heat the water within the loop in the winter, and a conventional air-source chiller to cool the water within the loop in the summer. Conventional boiler and chiller systems, which are relatively inefficient and which require rather extensive on-going maintenance, are well understood by those skilled in the art.

An alternate method of warming and cooling the water within such a loop has been to circulate the water in a series of underground loops, so as to use the naturally occurring heat in the earth's crust to heat the water in the winter and to cool the water in the summer. However, such water loops may be extensive in length, and are virtually always constructed of relatively thick walled polyethylene plastic, which has a poor heat conductivity rate, especially at the rather low circulating water to exterior ground temperature typical temperature differentials (often only 5 degrees to 15 degrees F.). As is well known by those skilled in the art, the lower the temperature differentials, the worse the heat transfer abilities.

Currently, the use of DX systems, absent the use of a supplemental refrigerant pump, which requires extra power, and absent the use of rather uncommon high pressure compressors and refrigerants, are limited to operational depths of about 600 feet, with a working envelope restriction of about 650 feet between the bottom of a deep well/borehole and the top of an interior heat exchange means, such as an air handler. However, DX systems typically operate at circulating refrigerant and adjacent geothermal temperature differentials of about 20 to 100 degrees F., thereby materially facilitating geothermal heat transfer over other conventional means, with materially reduced land area and materially reduced excavation requirements, to provide the same total BTU load capacities.

Thus, it would be preferable to use a DX system to replace conventional, and far less efficient, boiler/chiller systems, and to replace older, less efficient, and greater land area and work intensive, sub-surface water circulating heating/cooling system designs. In such a preferred design, referred to herein as a DX Hydronic System, a DX system design would be used to at least one of heat and chill the water, or water and antifreeze, circulating within a building/structure. Since the water within the structure traveling down from the top offsets the head pressure of the water within the structure traveling up, only a water circulator pump is required to maintain the water flow within the building.

Thus, in such a DX Hydronic system design, at least one DX system, and preferably two DX systems, would be used to at least one of heat and chill the water/liquid in a loop exiting the building/structure, so as to provide the requisite entering water/liquid temperature that keeps the water/liquid circulating within the building within optimal design parameters. In this manner a dedicated field of deep well DX systems, or a dedicated array of DX systems with subsurface heat exchange tubing situate within a lake or a bay, even if located miles away from the structure could be used to heat or cool the subject building's water loop, which water loop could be insulated and easily transported necessary distances. The use of such DX systems would at least one of materially increase operational efficiencies, materially reduce maintenance/repair costs, eliminate the necessity for exterior equipment exposed to the weather, eliminate the dangers associated with fossil fuels often used in boilers, reduce current roof structural reinforcement and roof leaking concerns, and materially reduce surface land area requirements.

When such multiple DX systems are used to at least one of heat and chill a liquid, water, or water and antifreeze, circulating within a structure, it would be preferable to alternate each respective used when less than the full number of available systems are required, so as not to overstress the ground surrounding the geothermal heat exchange tubing of any one particular system. This is why at least two primary DX systems are preferable for a DX Hydronic system application. For example, if the interior heating/cooling load requirement was light, only one primary DX system might be required to heat/cool the interior water loop, and if the same system were to always be used, the ground surrounding that system's heat exchange loop could become over-stressed and reduce system operational efficiencies, or require additional and supplemental DX systems to become operative. Whereas, if multiple systems were programmed, via a programmable controller, operably connected to each respective compressor box via control wire, or the like, to alternate when less than full capacity of all available systems was required, each respective system would be able to provide the ground surrounding its respective heat exchange tubing with an extended "rest" period within which to recover close to naturally occurring sub-surface temperature ranges.

A "DX Hydronic" system design, may include only one, or preferably multiple, primary and conventional DX system(s), with each respective system being comprised of a compressor box, a primary refrigerant to water heat exchanger, and a sub-surface heat exchange loop, with each loop comprised of at least one respective liquid refrigerant transport line and one respective vapor refrigerant transport line. However, as explained, at least two primary DX systems are preferred, so as to provide alternating geothermal heat source/heat sink rest periods.

The at least one primary refrigerant to water heat exchanger, which provides heating or cooling to the circulating water loop as needed, would typically be coupled to a water/liquid loop circulating within a building/structure, although other applications could be used. Each individual room of the building/structure, for example, would have at least one of a water/liquid to air radiator and at least one "mini" DX system, comprised of a small scale water to refrigerant heat exchanger, a small scale compressor box, and a small scale air handler, all using small scale DX system technology (which is well understood by those skilled in the art), so as to provide at least one of heated and chilled air to each respective room. Via the subject system DX Hydronic system design, only at least one primary operational DX system is able to simultaneously provide heated and cooled air to respective interior rooms, which has heretofore not been practically possible with historical DX system designs.

Further, rather than simply circulating the heated or chilled water through water to air heat exchangers/radiators (such radiators are well understood by those skilled in the art), as is commonly done via conventional boiler/chiller systems, it would be preferable, as explained, to use a mini-DX system, that exchanges heat to/from the circulating water loop (which water loop is primarily conditioned by the exterior field array of primary DX geothermal systems) to/from refrigerant within a mini-DX unit to/from interior air, in each of the structure's rooms or general areas.

The advantage of using a mini-DX system design, as opposed to simple water to air heat exchangers, would be that the primary water loop's temperature could be maintained within a wider temperature range than via conventional water-source geothermal designs, since the mini-DX systems situated within the building's interior space could operate, and provide comfortable heating/cooling levels, with the primary water loop's temperature ranging from as much as from 38 degrees F. to 80 degrees F., but preferably within an optimum water loop temperature range of 50 degrees F. to 65 degrees F. (where testing has shown maximum operational efficiencies are achieved). This requires less work from the primary DX system field installation, and materially reduces overall system operational power requirements. Further, this helps prevent rooms at the end of the primary circulating water loop from getting too hot in the summer and too cold in the winter.

Such mini-DX systems for use in various interior rooms or areas should preferably have at least one of the following proprietary devices developed by Wiggs; specially designed heating/cooling mode expansion devices, an oil separator, a receiver, a special accumulator, reduced capacity compressors, and specially designed interior air handler refrigerant transport finned tubing lengths.

(10) Oil separators commonly have floats that rise when too much oil has been lost from the system's compressor so as to permit oil accumulated at the bottom of the oil separator container to be pulled back into at least one of the compressor and the compressor's suction line, as is well understood by those skilled in the art.

However, the floats on most all oil separators are held in place by means of a lever. The lever, after years of repeated use, can wear out or otherwise become damaged (such as by too much moisture or debris in the circulating refrigerant/oil fluid). Thus, so as to improve current design, so as to reduce the chances of float lever malfunction (which could lead to compressor burnouts and/or other system malfunctions), the float should preferably be comprised of a float situated on top of the oil return line to the system's compressor, within vertically oriented containment bars, together with a containment cap. In the alternative, as would be apparent, although not shown in the detailed drawings of this disclosure, the float could be weighted and/or could have a variety of shapes and configurations, such as donut shaped, or the like, and have one vertically oriented containment bar in the center, with a containment cap. This would eliminate the chances of lever failures and system damage. When enough oil accumulated at the bottom of the oil separator to lift the float, the desired accumulated amount of oil above the top of the oil return line would be sucked back into the compressor via the compressor's suction line, in a similar manner as when a hinged float rose, as is well understood by those skilled in the art.

Further, the float itself should be made of a material strong enough to resist damage when more than 50 psi per second of refrigerant charge or nitrogen, or the like, is added to the system. The strong material may be at least one of stainless steel and a solid plastic, or the like, material that will not be crushed or otherwise damaged by the fast addition, or by the fast deletion, of pressure. Preferably, the strong material would withstand sudden pressure changes in excess of fifty psi per second, and preferably up to at least seven hundred psi per second.

(11) A "mobile" DX system would be of extreme advantage for transient office/housing applications, such as might be used by the military and/or engineering field services, and the like. Currently, for example, either no cooling is provided in the summer for such applications, or cooling is provided in the summer, and heating in the winter, only at great expense, typically via the expenditure of fuel oil or gas burning generators (supplying electricity for air-conditioning) or heaters (directly burning fossil fuels to generate heat.

The obvious problem encountered via using a much more efficient DX system design for a mobile facility is that the site may be soon abandoned, and the typical necessary initial DX system installation drilling/grouting costs are forfeited.

Thus, a means to provide a "mobile" DX system design would be highly advantageous. Such a design may be accomplished via the provision of a large water and/or other fluid (such as antifreeze, or the like) tank/container, which tank/container preferably has at least a metal bottom and preferably a metal bottom and metal sides, so as to facilitate at least one of conductive and convective heat transfer. The tank/container would be mounted on a movable trailer, a truck, or the like, with wheels for instant mobility.

The tank/container would be cover shaded during the summer, and would be left exposed to the sun in the winter. The cover shade would be removed in the winter so as to provide additional natural radiant heat from the sun. The heat transfer tubing would preferably be placed at or near the bottom of the fluid filled tank/container in the cooling mode, and would be placed at or near the top of the tank/container in the heating mode, as heated water naturally rises, and cooled water naturally falls. Thus, the refrigerant transport heat exchange tubing would be in the coolest water in the summer, and in the warmest water in the winter.

A potable water container to catch and store the condensate/potable water generated via the air handler (an indoor air handler, or the like, would be used, but the air handler would be covered with a protective covering when exposed to outdoor conditions) in the cooling mode and should preferably be placed under the air handler's condensate drain if potable water is desired. If potable water is not an issue, the air handler should be positioned far enough above the elevation of the tank/container so that the condensate water will gravity drain back down into the tank/container, to help replenish water lost by accelerated evaporation into the air caused by the relatively high level heat being absorbed by the water from the heated vapor refrigerant transport line in the cooling mode. Heated water naturally evaporates at a faster rate than cooler water. An operable vapor refrigerant transport line would also be installed between the system's compressor box and air handler. Operable liquid refrigerant transport lines would additionally be installed between the compressor box and the air handler, as well as between the compressor box and the heated vapor refrigerant transport line within the tank/container.

Preferably, wherever possible, the tank/container should be removed from the trailer and preferably set within at least one of a stream and a lake, or the like, and the natural water table (if close enough to the surface), or, alternatively if no natural water is readily available, on bedrock (if close enough to the ground surface), so as to assist in natural conductive heat transfer. Such a system design eliminates the need for an exterior fan, and an exterior fan's power draw, that is required with a conventional air-source heat pump system (an exterior fan and a conventional air-source heat pump system are well understood by those skilled in the art).

Additionally, in the cooling mode, when placement of tank/container within naturally occurring water is not possible, the water/fluid within the tank/container should preferably be modestly and continuously supplied and/or supplemented with water from a water well, or other available body of water (not shown since obvious), so as to continuously provide cooler water to the tank/container. The supplemented water would be supplied via a pump, through a water supply line, from a water filled water well, and/or supplied via at least one of a pump and natural drainage from a nearby stream or other body of water. Unlike a conventional water-source heat pump that may require several gallons of water flow per minute per ton of system design capacity, which is well understood by those skilled in the art, such a "mobile" DX system design will only require a fraction of such a conventional system design water flow rate, thereby reducing conventional water-source geothermal operational power requirements.

If no naturally occurring water is available to place the tank/container into, and/or if no supplemental central well is available, and/or if no excavation equipment is available to at least partially bury the tank/container below the ground surface, the tank/container should at least preferably be temporarily placed on top of the ground surface so as to provide at least some conductive heat transfer with the ground.

Thus, at a minimum, such a "mobile" DX system would be comprised of a large water and/or other fluid tank/container, which tank/container preferably has at least one of a metal bottom and metal sides, which tank/container is mounted on at least one of a movable trailer and a moveable vehicle with wheels, which tank/container would be covered/shaded during the summer, and would be left exposed to the sun in the winter, and which tank/container would have an array of sub-surface DX system heat transfer, refrigerant transport, tubing situate within the water/fluid within the tank/container, which refrigerant transport tubing would be operably connected to a DX system compressor box and air handler, which would both also be mounted on at least one of a movable trailer and a moveable vehicle with wheels. As would be well understood by those skilled in the art, the heated/cooled air exiting the mobile air handler could easily be ducted into at least one or more sites as desired.

(12) Also, another preferable design improvement for use in conjunction with a "portable" DX system is a "resting module", situated within a temporary tent that solely requires heating/cooling, as opposed the entire interior of a poorly insulated temporary tent. Such a "resting module" would be a well insulated compartment, with an appropriate fresh air intake, that would provide a heated/cooled environment sufficient for only one, or a few, people, thereby materially reducing the heating/cooling load requirements required for actual human comfort. The resting module would be supplied with one of heated and cooled air via a supply air duct and a return air duct from the above-described mobile DX system's air handler (not shown herein) for temporary uses. Supply air ducts and return air ducts from air handlers are well understood by those skilled in the art and are not shown in detail herein. For example, the resting module might contain a cot, a bed, a lounge chair, or the like.

As an alternative to the above-described "resting" module, at least one of cooled air and cooled water, or the like, could be circulated within one of a temperature conditioned blanket, thereby providing one of a "cooling blanket" and a "heating blanket", or a sac, for individual personal use. The cooling/heating conditioned blanket would be comprised, for example, of a covering (a fabric covering, or the like) containing multiple small capillary tubes that conveyed at least one of cooled and heated water and cooled and heated air, thereby minimizing available cooling/heating ability efficiencies losses in other than necessary design areas. The power necessary to provide such a relatively small capillary tube water flow would be more than offset by the primary system operational power required to otherwise cool/heat a much larger area via a fan with forced air convective cooling. The at least one of water and air in the capillary tubes would preferably be cooled and heated via a mobile DX system with a refrigerant to water heat exchanger, which mobile DX system has been hereinabove described, and which refrigerant to water heat exchanger is well understood by those skilled in the art.

BRIEF DESCRIPTION OF THE DRAWINGS

These and other aspects and features of the disclosure will become more readily apparent upon reading the following detailed description when taken in conjunction with the accompanying drawings.

Figure 1:
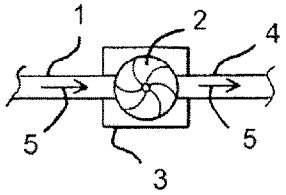
FIG. 1 is a side view of a turbine, powering an electrical generating device that is used for a heat pump, and preferably a DX heat pump, system's expansion device.

While the present disclosure is susceptible to various modifications and alternative constructions, certain illustrative embodiments thereof have been shown in the drawings and will be described below in detail. It should be understood, however, that there is no intention to limit the present disclosure to the specific forms disclosed, but on the contrary, the intention is to cover all modifications, alternative constructions, and equivalents falling within the spirit and scope of the present disclosure.

DETAILED DESCRIPTION

The following detailed description is of the best presently contemplated mode. The description is not intended in a limiting sense, and is made solely for the purpose of illustrating the general principles of the disclosure. The various features and advantages of the present disclosure may be more readily understood with reference to the following detailed description taken in conjunction with the accompanying drawings.

Referring now to the drawings in detail, where like numerals refer to like parts or elements, there is shown in FIG. 1 a side view of a higher pressure liquid refrigerant transport line 1, coupled to the turbine 2 of an electric generating device 3 (electrical generating devices operated by turbines 2 are well understood by those skilled in the art), which turbine 2 is also coupled to a liquid/vapor refrigerant fluid (not shown except for refrigerant flow directional arrows 5), lower pressure, refrigerant transport line 4. The turbine 2 of the electric generating device 3 permits refrigerant to flow through, from the higher pressure liquid line 1 side of the turbine 2 to the lower pressure line 4 side, but the turbine 2 is set to provide the desired resistance necessary to maintain the desired higher pressure refrigerant on the liquid line 1 side, and the desired lower pressure on the lower pressure line 4 side, as the refrigerant flows through the electrical generating device 3 in the direction of the arrow 5. The electric generator 3 takes the place of conventional expansion devices, such as TXVs, pin restrictors, and the like, which are all well understood by those skilled in the art. Conventional expansion devices restrict the refrigerant flow via a desired orifice passageway size, as is well understood by those skilled in the art. Thus, rather than simply providing an orifice type refrigerant flow restrictor (which are well understood by those skilled in the art) to maintain desired higher and lower refrigerant pressures on each respective side, the provision of a moveable restriction devise, such as a turbine 2 for an electric generator 3, not only maintains the desired higher and lower refrigerant pressures on each respective side, but provides useable energy, thereby reducing overall system power draw requirements and increasing operational efficiencies.

Figure 2:
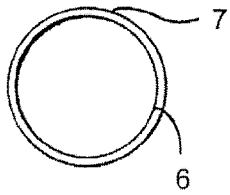
FIG. 2 is a top view of preferred refrigeration coating type and thickness to protect DX system heat transfer tubing in corrosive sub-surface environments.

FIG. 2 is a top view, not drawn to scale, of a refrigerant transport tube 6 with a low density polyethylene coating 7. A 0.01 inch to a 0.015 inch thick plastic coating 7, preferably comprised of polyethylene (which does not develop stress cracks as does PVC), or the like, which is preferable to protect copper/metal refrigerant transport tubing 6 in sub-surface environments that could be corrosive to copper tubing 6, but where minimal adverse heat transfer impairment is desired.

Figure 3:
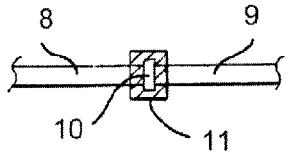
FIG. 3 is a side view of preferred refrigeration coating type and thickness to protect dissimilar metal connections in DX system sub-surface environments.

FIG. 3 is a side view of a standard DX system refrigerant transport copper line/tube 8 attached to a dissimilar metal, such as a refrigerant transport aluminum line/tube 9, or the like. The point of dissimilar metal attachment 10 may be coated 11 with a protective coating 11, such as polyethylene or the like, so as to prevent corrosion over time. Here, the point of dissimilar metal attachment 10 is shown as if the side of the protective coating 11 was cut away.

A low density polyethylene coating 11 thickness of at least 0.02 inches to 0.1 inches thick is preferable to coat 11 and protect sub-surface dissimilar metal joints/attachments 10.

Figure 4:
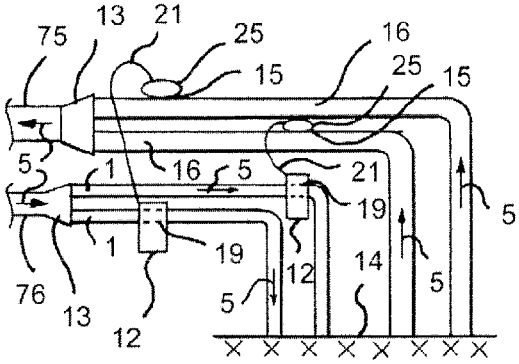
FIG. 4 is a side view of a DX system heating mode automatic expansion device design, with a bleed port.

FIG. 4 is a side view of at least one of an automatic expansion device and a self-adjusting expansion device 12, installed in the heating mode of system operation (which is well understood by those skilled in the art), on each of two respective distributed, by a distributor 13, smaller diameter liquid refrigerant transport lines 1 entering the sub-surface geology 14. Pressure sensing capillary tubes 21 (which are well understood by those skilled in the art) operatively connects the respective expansion devices 12 to respective temperature sensing bulbs 25, which are situated at the top twelve o'clock position 15 of the respective larger diameter vapor refrigerant transport lines 16 exiting the sub-surface geology 14. Distributors 13 equally divide refrigerant fluid flow, as is well understood by those skilled in the art, to/from a primary vapor refrigerant transport line 75 and a primary liquid refrigerant transport line 76 into multiple respective smaller liquid refrigerant transport lines 1 and into multiple respective smaller vapor refrigerant transport lines 16. Arrows 5 indicate the directional flow of refrigerant (not shown except for directional flow) in the heating mode of system operation. A refrigerant flow bleed port 19 is shown through each respective automatic/self-adjusting expansion device 12.

An electronic expansion device (not shown herein) would be in the same position, in the respective liquid refrigerant transport lines 1, as each respective automatic/self-adjusting expansion device 12, and would have the same temperature sensing bulbs 25 operatively connected, via capillary tubes 21, to the top twelve o'clock position 15 of each of the respective distributed 13 vapor refrigerant transport lines 16 exiting the sub-surface geology 14, but the bleed port 19, shown herein, would not be required, as an electronically controlled valve would have the ability to adjust its interior orifice size over a very wide range of temperature conditions, pursuant to the sizing/temperature conditions and formulas described hereinabove in this disclosure, as is well understood by those skilled in the art. A bleed port 19 is shown herein in each respective expansion device 12, the orifice size of which bleed port 19 is preferably sized, depending on at least one of refrigerant temperatures and pressures, as per preferred design sizing formulas described hereinabove.

Figure 4A:
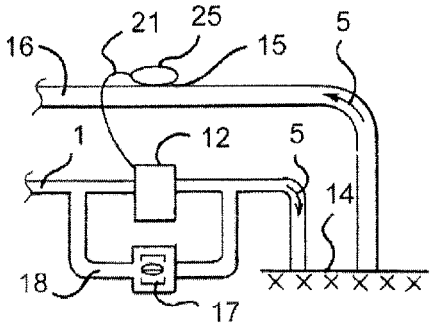
FIG. 4A is a side view of a DX system heating mode automatic expansion device design, with a by-pass line.

FIG. 4A is a side view of a pin restrictor 17, situated in a by-pass refrigerant transport line 18, which by-pass line 18 travels around at least one of automatic expansion device and a self adjusting expansion device 12 (an electronic expansion device would not require a by-pass line 18). As in FIG. 4 above, the smaller diameter liquid refrigerant transport line 1 (only a single liquid line 1 and a single vapor line 16 are shown here in FIG. 4A) enters the sub-surface geology 14. A capillary tube 21 (which is well understood by those skilled in the art) operatively connects the expansion device 12 to the temperature sensing bulb 25, which is situated at the top twelve o'clock position 15 of the larger diameter vapor refrigerant transport line 16 exiting the sub-surface geology 14. Arrows 5 indicate the directional flow of refrigerant (not shown) in the heating mode of system operation.

Figure 5:
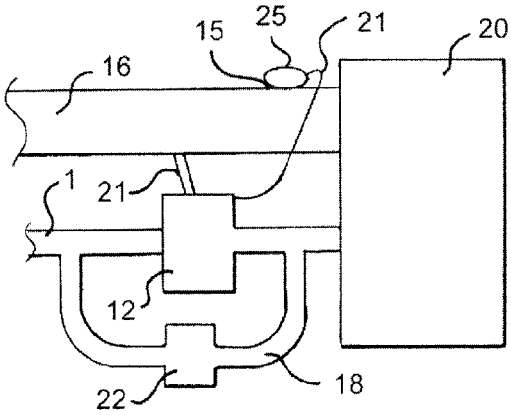
FIG. 5 is a side view of a DX system cooling mode TXV device design, with a by-pass line and special valve.

FIG. 5 is a side view of an automatic expansion device 12, commonly referred to as a "TXV", installed in the smaller diameter liquid refrigerant transport line 1 entering an interior air handler 20, for use in the cooling mode of system operation. Interior air handlers 20 are well understood by those skilled in the art. A larger diameter vapor refrigerant transport line 16 exits the air handler 20. As is well understood by those skilled in the art, both a pressure sensing capillary tube 21 and a temperature sensing bulb 25 are installed on the vapor line 16 exiting the air handler 20, and are both, 21 and 25, operatively attached to the TXV 12. Here, as previously disclosed, in a DX system application, the temperature sensing bulb 25 is preferably positioned at a top twelve o'clock position 15 on the vapor line 16 exiting the air handler 20, instead of at the historically/commonly recommended ten o'clock position.

A TXV 12 by-pass refrigerant transport line 18 is shown around the TXV 12, which by-pass line 18 contains a special pressure controlled valve 22 that begins to close off the by-pass line 18 at a refrigerant pressure of fifty psi, and that modulates to fully close off the by-pass line 18 when a refrigerant pressure of eighty psi is reached within the subject by-pass line 18. The modulation within the pressure controlled valve 22 would be controlled by at least one of a spring, an electronic sensing/control device, or the like, as all are well understood by those skilled in the art. Such a TXV by-pass line 18 and valve 22 are preferable for use when switching DX system operation from the heating mode to the cooling mode, when sub-surface temperatures are abnormally cold for cooling mode only operation.

Figure 6:
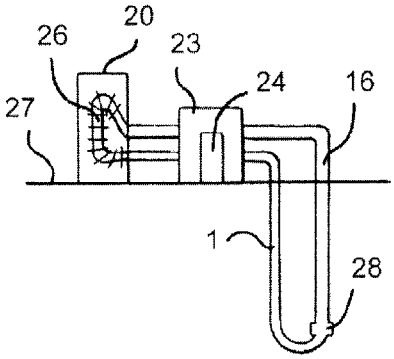
FIG. 6 is a side view of a DX system's compressor, air handler, and sub-surface heat exchange loop, with preferred compressor sizing and ground loop specifications disclosed.

FIG. 6 is a side view of an interior air handler 20 that is operatively connected to a compressor box 23 (compressor boxes typically contain compressors 24, reversing valves (not shown), accumulators (not shown), electric control panels (not shown), and the like, all of which are well understood by those skilled in the art). For a DX system application with a preferable R-410A refrigerant, a reciprocal compressor 24, which is well understood by those skilled in the art, is preferably downsized 15%, plus or minus 4% of 100%, of the system design capacity in BTUs. System design capacities in BTUs for compressors 24 are well understood by those skilled in the art. Thus, for a five ton, or 60,000 BTU, system load design, the actual DX system compressor 24 size should be one of a 51,000 BTU capacity, plus or minus 4%. A smaller diameter liquid refrigerant transport line 1 is here shown as coupling 28 the larger diameter vapor line 16, used for geothermal heat transfer below the ground surface 27, to the compressor box 23.

The amount of refrigerant transport geothermal heat exchange vapor line 16 tubing exposed to the sub-surface environment below the ground surface 27 should preferably be comprised of a length that is equal to at least 0.01 feet per BTU of system design load capacity (which design load capacity is well understood by those skilled in the art), except where the vapor refrigerant transport tubing 16 used for heat transfer purposes is coated with a 0.01 inch to a 0.015 inch thick wall of a protective coating (a protective coating is not shown in this drawing, but has been shown and explained in FIG. 2 above), when, in such case, the vapor refrigerant transport line 16 used for geothermal heat transfer should preferably be comprised of a length equal to 0.0125 feet per BTU of system design load capacity.

Figure 7:
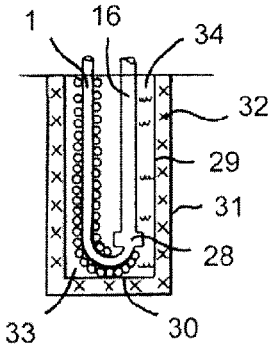
FIG. 7 is a side view of a DX system's vertically oriented geothermal heat exchange loop, situated, so as to be removable, within a containment pipe placed within a well/borehole. Here, the liquid refrigerant transport line is shown as being insulated with a preferable low density polyethylene coating with a specified minimum wall thickness, and the preferred sizing of the liquid and vapor refrigerant transport lines at varying depths are disclosed.

FIG. 7 is a side view of a four inch I.D. interior metal pipe 29, with a sealed lower distal end cap 30. The pipe 29 should be installed within an approximate five to six inch diameter well/borehole 31. The exterior of the borehole 31 is shown as grouted with a cementitious type grout 32, such as Grout 111 . The smaller liquid refrigerant transport line I within the well/borehole 31 is insulated 33 (for heat transfer inhibition purposes) with at least a 0.05 inch thick wall (not drawn to scale) of low density, solid state, polyethylene, or the like, that is not corrosive to the refrigerant transport tubing 1. Here, a 0.0625 foot O.D. vapor refrigerant grade transport line 16 and a 0.03125 foot O.D. liquid refrigerant grade transport line 1 (typically copper refrigerant transport lines) are shown (not drawn to scale), which liquid 1 and vapor 16 lines are coupled 28 at or near the bottom of the well/borehole 31 so as to provide at least one of a DX system's geothermal heat exchange loop in wells 31 down to a four hundred foot depth. In wells 31 between 401 and 600 feet deep, a 0.0625 foot O.D. vapor refrigerant grade transport line 16 and a 0.04166 foot O.D. liquid refrigerant grade transport line 1 would preferably be used.

If the metal refrigerant transport loop containment piping 29 is installed within a corrosive environment, the piping 29 may preferably be coated on the exterior with a protective coating, which coating is not shown herein, but would be the same or similar to the coating applied to copper tubing in a corrosive sub-surface environment, as more fully described hereinabove in FIG. 2.

The empty annular space within the well/borehole 31, after the refrigerant transport lines, 1 and 16, have been installed, is filled with at least one of a heat conductive fluid and gel 34.

Figure 8:
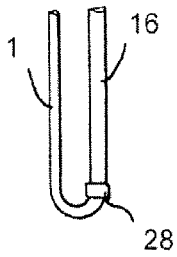
FIG. 8 is a side view of a DX system's vertically oriented geothermal heat exchange loop, with the preferred sizing of the liquid and vapor refrigerant transport lines at varying depths being disclosed.

FIG. 8 is a side view of a refrigerant grade vapor refrigerant transport tube 16, used for heat transfer purposes, which vapor tube 16 preferably has a 0.0625 foot outside diameter ("O.D."), plus or minus 10% in well 31 depths down to six hundred feet. The vapor tube/line 16 is coupled 28 to an accompanying refrigerant grade liquid refrigerant transport tube 1, which liquid tube/line 1 should preferably have a 0.03125 foot outside diameter ("O.D."), plus or minus 10% in well 31 depths down to four hundred feet, and which liquid tube/line 1 should preferably have a 0.04166 foot outside diameter ("O.D."), plus or minus 10% in well 31 depths between four hundred one and six hundred feet. Further, the vapor refrigerant transport line/tube 16 used for geothermal heat transfer should preferably be comprised of a length equal to 0.01 feet per BTU of system design load capacity. BTU system design load capacities are well understood by those skilled in the art. However, where the commonly metal vapor refrigerant transport tube 16 used for heat transfer purposes, is coated with a 0.01 inch to a 0.02 inch thick wall of a protective plastic coating, such as polyethylene (not shown herein, but as more fully shown and described hereinabove in FIG. 2), the vapor refrigerant transport line 16 used for geothermal heat transfer should preferably be comprised of a length equal to 0.0125 feet per BTU of system design load capacity. A geothermal heat transfer loop is commonly comprised of a liquid refrigerant transport line 1 coupled 28 to a vapor refrigerant transport line 16.

Figure 9:
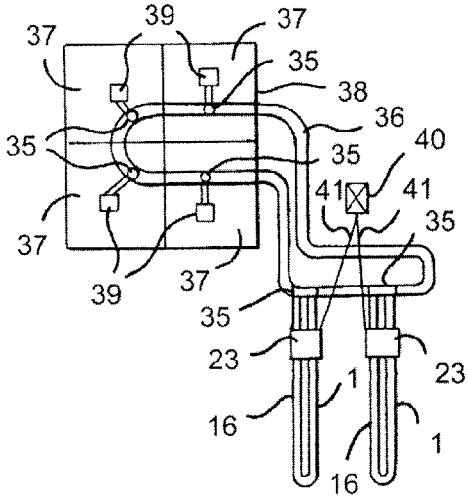
FIG. 9 is a side view of "DX Hydronic" system design.

FIG. 9 is a side view of a "DX Hydronic" system design, which here includes two primary and conventional DX system designs using two respective standard size DX system compressor boxes 23, two respective primary refrigerant to water heat exchangers 35 (refrigerant to water heat exchangers are well understood by those skilled in the art, and typically consist of a refrigerant transport tube wrapped around, or placed within, a water transport tube/line 36 so as to effect conductive heat transfer, absent any mechanical energy, such as a fan (not shown) typically required to transfer refrigerant heat to air via convective heat transfer), and two respective sub-surface heat exchange loops (shown here as beneath the compressor boxes 23) comprised of two respective smaller diameter liquid refrigerant transport lines 1 and two respective larger diameter vapor refrigerant transport lines 16.

The two primary refrigerant to water heat exchangers 35 are coupled to a water tube/line 36 loop, which water transport tube/line 36 loop circulating within a building/structure 38, so as to provide heating or cooling to the circulating water loop 36, so as to maintain the water, or water and antifreeze (not shown) within the loop 36 within optimally designed temperature ranges (at least between 38 degrees and 80 degrees F., and preferably between 50 degrees and 65 degrees F. with an r-410A system) so as to provide heating/cooling as needed by the respective rooms 37 within the building 38. Each individual room 37 of the building/structure 38 is shown here as having a "mini" DX system 39 (components not shown herein but preferably comprised of a small scale water to refrigerant heat exchanger, a small scale compressor box, a small scale oil separator, a small scale accumulator/receiver, and a small scale air handler, and the like), so as to provide at least one of heated and chilled air, by original heat transfer means of a small refrigerant to water heat exchanger 35, to each respective room 37. Via the subject system design, only one primary operational DX system is able to simultaneously provide heated and cooled air to respective interior rooms 37.

A programmable controller 40 is shown as operably attached, via control wire 41, or the like, to each primary compressor box, so as to alternate each system's respective operational engagement when only one compressor box 23 and system is required to maintain the desired temperature range of the water (not shown) within the water transport tubing 36 loop. This prevents any one particular DX system from over-stressing its respective geothermal heat transfer ability. The water transport tube/line 36 loop is shown herein as a single loop. However, as would be well understood by those skilled in the art, the water transport tube/line 36 shown here could be alternately designed as at least one of a two loop and a four loop water transport system. Also, as is well understood by those skilled in the art, what is herein described as a water transport tube/line 36, may also transport water and antifreeze, or any other acceptable/desirable liquid.

Figure 10:
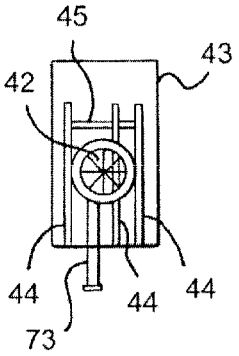
FIG. 10 is a side view of an improved oil separator float design.

FIG. 10 is a side view of a float 42 within an oil separator 43. The float 42 is maintained in position on top of an oil return line 73, ultimately returning oil (oil not shown) to the compressor (compressor not shown) by at least three vertically oriented bars 44, with a float 42 containment bar/cap/top 45, to prevent the float 42 from traveling too high within the oil separator 43. The float 42 would preferably be constructed of a rugged material that would withstand sudden pressure changes in excess of fifty psi, and preferably up to at least seven hundred psi per second. The complete construction of an oil separator 43 (which typically includes screening or filters or centrifugal force to separate oil from refrigerant) is not shown herein, as same is well understood by those skilled in the art.

Figure 11:
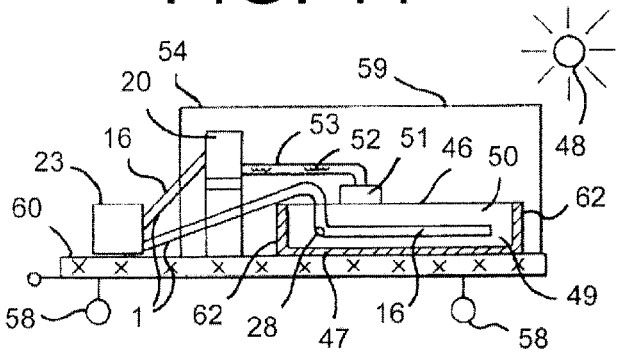
FIG. 11 is a side view of mobile DX system design.

FIG. 11 is a side view of a mobile DX system design, comprised of a large water and/or other fluid (such as antifreeze, or the like) tank/container 46, which tank/container 46 preferably has at least at least a metal bottom 47, and preferably has a metal bottom 47 and metal sides 62, so as to facilitate at least one of conductive and convective heat transfer. The tank/container 46 is shown herein as mounted on a movable trailer 60 with wheels 58 for instant mobility.

The tank/container 46 would be cover shaded 59 during the summer, and would be left exposed to the sun 48 in the winter. Here a cover shade 59 is shown. The cover shade 59 would be removed (not shown since obvious) in the winter so as to provide additional natural radiant heat from the sun 48. Although shown here as approximately centrally located within the tank/container 46, the heat transfer/vapor refrigerant transport tubing 16 would be placed at or near the bottom 49 of the fluid filled tank/container 46 in the cooling mode, and would be placed at or near the top 50 of the tank/container 46 in the heating mode, as heated water naturally rises, and cooled water naturally falls. Thus, the refrigerant transport heat exchange tubing 16 would be in the coolest water in the summer, and in the warmest water in the winter.

A potable water container 51 to catch and store the condensate/potable water 52 generated via the air handler 20 (an indoor air handler 20, or the like, would be used, but the air handler 20 would be covered with a protective covering 54 when exposed to outdoor conditions) in the cooling mode should preferably be placed under the air handler's 20 condensate drain 53 if potable condensate water 52 is desired. If potable condensate water 52 is not an issue, the air handler 20 should be positioned tar enough above the elevation of the tank/container 46 so that the condensate water 52 will gravity drain back down into the tank/container 46 (not shown herein since removal of the potable water container 51 would be obvious), to help replenish water lost by accelerated evaporation into the air caused by the relatively high level heat being absorbed by the water from the heated vapor refrigerant transport line 16 within the tank/container 46 in the cooling mode. Heated water naturally evaporates at a faster rate than cooler water. An operable vapor refrigerant transport line 16 is also shown herein between the system's compressor box 23 and air handler 20, which are also mounted on the moveable trailer 60. Operable liquid refrigerant transport lines 1 are additionally shown between the compressor box 23 and the air handler 20, as well as between the compressor box 23 and the coupling 28 to the warm vapor refrigerant transport line 16 within the tank/container 46.

Figure 11A:
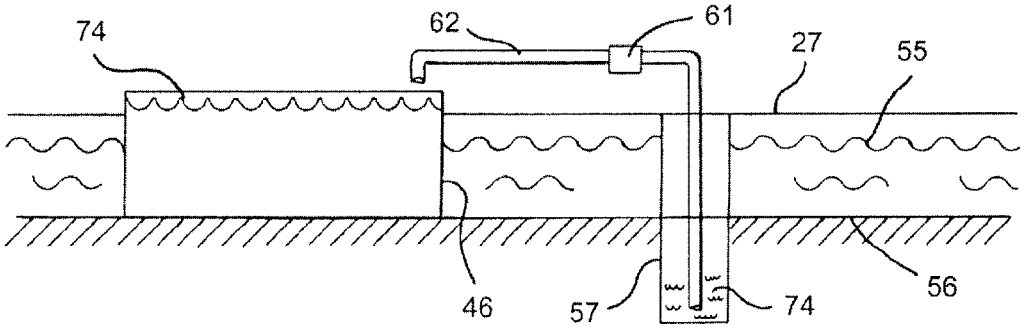
FIG. 11A is a side view of a semi-mobile DX system design.

FIG. 11A is a side view of the tank/container 46 that has been removed from the trailer 60 in FIG. 11 (not shown herein) and preferably set within at least one of a stream and a lake, or the like, and the natural water table 55 (if close enough to the ground surface). Thus, the subject drawing depicts a semi-mobile DX system design that can be optionally moved to differing locations at will.

As additionally shown herein, the tank/container 46, is also set (not permanently) on bedrock 56, so as to assist in natural conductive heat transfer. Such a system design eliminates the need for an exterior fan, and an exterior fan's power draw, that is required with a conventional air-source heat pump system (an exterior fan and a conventional air-source heat pump system are not shown herein as same are well understood by those skilled in the art).

Additionally, in the cooling mode, when placement of tank/container 46 within naturally occurring water 55 is not possible, the water/fluid/liquid 74 within the tank/container 46 should preferably be modestly and continuously supplied and/or supplemented with water 74 from a central water well 57, or other available body of water (not shown since obvious), so as to continuously provide cooler water 74 to the tank/container 46. The supplemented water 74 would be supplied via a pump 61, through a water supply line 63, from a water-filled 74 water well 57, and/or supplied via at least one of a pump 61 and natural drainage from a nearby stream or other body of water (not shown since obvious). Unlike a conventional water-source heat pump that may require several gallons of water flow per minute per ton of system design capacity, which is well understood by those skilled in the art, such a "mobile" DX system design will only require a fraction of such a conventional system design water flow rate, thereby reducing conventional water-source geothermal operational power requirements.

If no naturally occurring water 55 is available to place the tank/container into, and/or if no supplemental water well 57 is available, and/or if no excavation equipment is available to at least partially bury the tank/container below the ground surface 27, the tank/container 46 should at least preferably be temporarily placed on top of the ground surface 27 so as to provide at least some conductive heat transfer with the ground 27. The tank/container 46 sitting on top of the ground surface 27 is not shown herein as same would be obvious.

Figure 12:
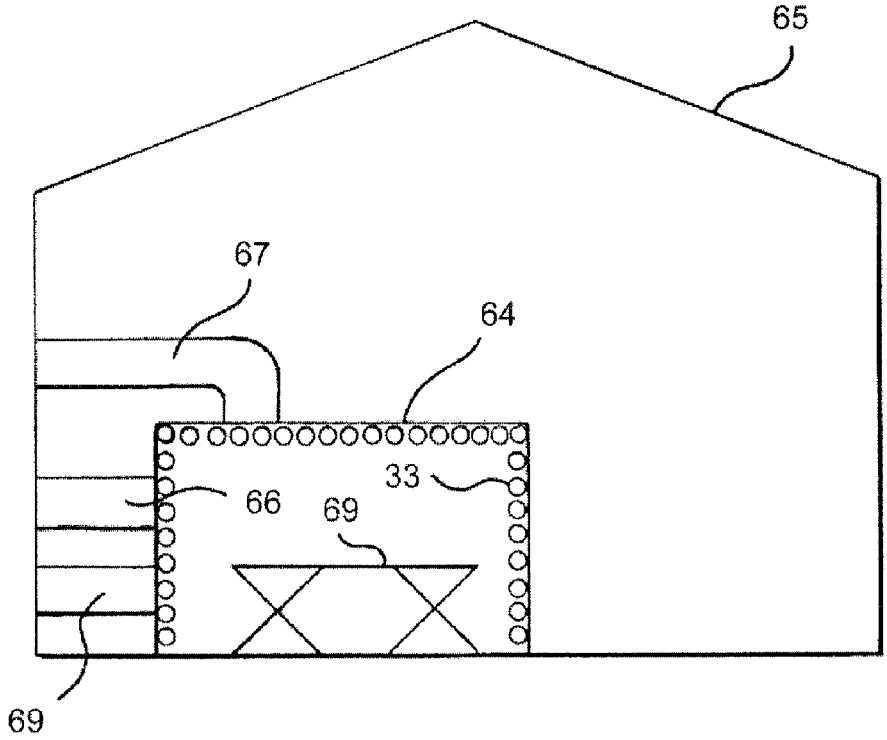
FIG. 12 is a side view of a resting module DX system design.

FIG. 12 is a side view of a "resting module" 64, situated within a temporary tent 65, that solely requires heating/cooling, as opposed the entire interior of a poorly insulated temporary tent 65. Such a "resting module" 64 would be a well insulated 33 compartment, with an appropriate fresh air intake 66, that would provide a heated/cooled environment sufficient for only one, or a few, people, thereby materially reducing the heating/cooling load requirements required for actual human comfort. The resting module 64 would be supplied with one of heated and cooled air via a supply air duct 67 and a return air duct 68 from the above-described mobile DX system's air handler (not shown herein) for temporary uses. Supply air ducts 67 and return air ducts 68 from air handlers are well understood by those skilled in the art and are not shown in detail herein, other than the supply air duct 67 and the return air duct 68 to/from the resting module 64 For example, the resting module 64 might contain a cot 69, a bed, a lounge chair, or the like (not shown).

Figure 12A:
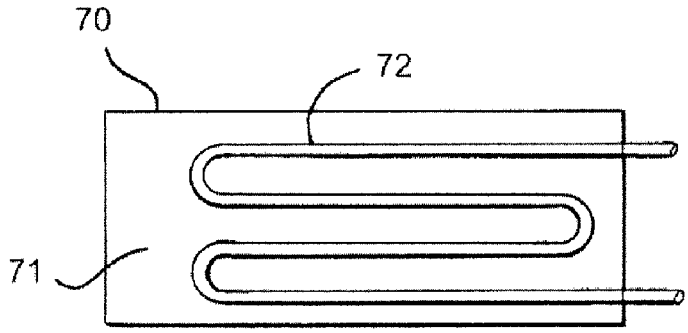
FIG. 12A is a top view of a heating/cooling blanket DX system design.

FIG. 12A is a top view of at least one of a temperature conditioned blanket 70, providing one of a "cooling blanket" and a "heating blanket" for individual person use. The cooling/heating conditioned blanket 70 would be comprised of a covering 71 (a fabric covering 71, or the like) containing multiple small capillary tubes 72 that conveyed at least one of cooled and heated water and/or cooled and heated air (water and air are not shown herein), thereby minimizing available cooling/heating ability efficiencies losses in other than necessary design areas. The power necessary to provide such a relatively small multiple capillary tube 72 water and/or air flow would be more than offset by the primary system operational power required to otherwise cool/heat a much larger area via a fan with forced air convective cooling (not shown). The water and/or air (not shown) in the capillary tubes 72 would preferably be cooled and heated via a mobile DX system, which mobile DX system has been hereinabove described.

While only certain embodiments have been set forth, alternatives and modifications will be apparent from the above description to those skilled in the art. These and other alternatives are considered equivalents and within the spirit and scope of this disclosure and the appended claims.

What is claimed:

1. A direct exchange geothermal heating/cooling system for use with a sub-terranean formation and having a system heating/cooling capacity rating, the system comprising:

an interior heat exchanger;

a vapor refrigerant line fluidly communicating with the interior heat exchanger, the vapor refrigerant line including an above-surface vapor line portion and a sub-terranean vapor line portion;

a liquid refrigerant line fluidly communicating with the interior heat exchanger, the liquid refrigerant line including an above-surface liquid line portion and a sub-terranean liquid line portion;

an exterior heat exchanger defined by the sub-terranean vapor line portion and the sub-terranean liquid line portion;

a compressor disposed in the above-surface vapor line portion and configured to circulate a refrigerant through the interior heat exchanger, the vapor refrigerant line, and the liquid refrigerant line, the compressor having a compressor capacity rating in BTUs;

a heating mode expansion device having a valve element disposed in the above-surface liquid line portion;

a heating mode bypass disposed in the above-surface liquid line portion and configured to fluidly communicate around the valve element of the heating mode expansion device, the heating mode bypass having a flow restriction with a flow restriction diameter selected to be within 10% of a temperature adjusted flow restriction diameter based, at least in part, on the compressor capacity rating; and a temperature sensing bulb operatively coupled to the heating mode expansion device and thermally coupled to the vapor refrigerant line.

2. The system of claim 1, in which the temperature adjusted flow restriction diameter is calculated as follows:

determining a nominal flow restriction area by dividing the compressor capacity rating by 1000 and multiplying by an area factor of 0.0000391;

converting the nominal flow restriction area into a nominal flow restriction diameter;

determining a temperature factor by measuring a temperature of the refrigerant exiting the sub-terranean formation in degrees Celsius and multiplying by 2; and adding the temperature factor to the nominal flow restriction diameter to obtain the temperature adjusted flow restriction diameter.

3. The system of claim 1, in which the temperature sensing bulb is located substantially at a twelve o'clock position on the vapor refrigerant line.

4. The system of claim 1, in which the refrigerant comprises R-410A refrigerant, and the heating mode expansion device has an expansion device capacity rating that is at least approximately 20% higher than the system heating/cooling capacity rating.

5. The system of claim 4, in which the system heating/cooling capacity rating is approximately 4 tons, and the expansion device capacity rating is approximately 5 tons.

6. The system of claim 1, in which the heating mode bypass comprises a pin restrictor disposed in a bypass line and the flow restriction comprises a borehole of the pin restrictor.

7. The system of claim 1, in which the heating mode bypass comprises a bleed line extending through the heating mode expansion device and the flow restriction comprises a bleed port formed in the bleed line.

8. The system of claim 1, in which the heating mode expansion device comprises a self-adjusting expansion device.

9. The system of claim 1, in which the heating mode expansion device comprises an automatic expansion device.

10. A direct exchange geothermal heating/cooling system for use with a sub-terranean formation and having a system heating/cooling capacity rating, the system comprising:

an interior heat exchanger;

a vapor refrigerant line fluidly communicating with the interior heat exchanger, the vapor refrigerant line including an above-surface vapor line portion and a sub-terranean vapor line portion;

a liquid refrigerant line fluidly communicating with the interior heat exchanger, the liquid refrigerant line including an above-surface liquid line portion and a sub-terranean liquid line portion;

an exterior heat exchanger defined by the sub-terranean vapor line portion and the sub-terranean liquid line portion;

a compressor disposed in the above-surface vapor line portion and configured to circulate a refrigerant through the interior heat exchanger, the vapor refrigerant line, and the liquid refrigerant line;

a heating mode expansion device having a valve element disposed in the above-surface liquid line portion; and a temperature sensing bulb operatively coupled to the heating mode expansion device and thermally coupled to the vapor refrigerant line, the temperature sensing bulb being located substantially at a twelve o'clock position on the vapor refrigerant line.

11. The system of claim 10, in which the refrigerant comprises R-410A refrigerant, and the heating mode expansion device has an expansion device capacity rating that is at least approximately 20% higher than the system heating/cooling capacity rating.

12. The system of claim 10, in which the heating mode expansion device comprises a self-adjusting expansion device.

13. The system of claim 10, in which the heating mode expansion device comprises an automatic expansion device.

14. The system of claim 10, in which the heating mode expansion device comprises an electronic expansion device.

15. The system of claim 10, in which the compressor has a compressor capacity rating in BTUs, a heating mode bypass is disposed in the above-surface liquid line portion and configured to fluidly communicate around the valve element of the heating mode expansion device, the heating mode bypass having a flow restriction with a flow restriction diameter selected to be within 10% of a temperature adjusted flow restriction diameter, and the temperature adjusted flow restriction diameter is calculated as follows:

determining a nominal flow restriction area by dividing the compressor capacity rating by 1000 and multiplying by an area factor of 0.0000391;

converting the nominal flow restriction area into a nominal flow restriction diameter;

determining a temperature factor by measuring a temperature of the refrigerant exiting the sub-terranean formation in degrees Celsius and multiplying by 2; and adding the temperature factor to the nominal flow restriction diameter to obtain the temperature adjusted flow restriction diameter.

16. A direct exchange geothermal heating/cooling system for use with a sub-terranean formation and having a system heating/cooling capacity rating, the system comprising:

an interior heat exchanger;

a vapor refrigerant line fluidly communicating with the interior heat exchanger, the vapor refrigerant line including an above-surface vapor line portion and a sub-terranean vapor line portion;

a liquid refrigerant line fluidly communicating with the interior heat exchanger, the liquid refrigerant line including an above-surface liquid line portion and a sub-terranean liquid line portion;

an exterior heat exchanger defined by the sub-terranean vapor line portion and the sub-terranean liquid line portion;

a compressor disposed in the above-surface vapor line portion and configured to circulate a refrigerant through the interior heat exchanger, the vapor refrigerant line, and the liquid refrigerant line, the compressor having a compressor capacity rating in BTUs;

a cooling mode expansion device having a valve element disposed in the above-surface liquid line portion;

a temperature sensing bulb operatively coupled to the cooling mode expansion device and thermally coupled to the vapor refrigerant line;

a cooling mode bypass disposed in the above-surface liquid line portion and configured to fluidly communicate around the valve element of the cooling mode expansion device;

a bypass valve disposed in the cooling mode bypass, the bypass valve being configured to automatically operate in response to a fluid line refrigerant pressure.

17. The system of claim 16, in which the bypass valve is configured to:

be fully open at a fluid line refrigerant pressure of approximately 50 psi or less;

be fully closed at a fluid line refrigerant pressure of approximately 80 psi or more; and modulate between fully open and fully closed at a fluid line refrigerant pressure between approximately 50 psi and approximately 80 psi.

18. The system of claim 17, in which the above-surface liquid line portion has a liquid line diameter, the cooling mode bypass has a bypass diameter, and the bypass diameter is substantially equal to the liquid line diameter.

19. The system of claim 16, in which the temperature sensing bulb is located substantially at a twelve o'clock position on the vapor refrigerant line.

20. The system of claim 16, in which the cooling mode expansion device comprises a self-adjusting thermostatic expansion valve.

21. The system of claim 16, in which the cooling mode bypass comprises a bleed line extending through the cooling mode expansion device.

22. The system of claim 16, in which the cooling mode bypass comprises a cooling mode bypass line extending around the cooling mode expansion device.

* * * * *